US010981752B2

(12) United States Patent
Witczak et al.

(10) Patent No.: US 10,981,752 B2
(45) Date of Patent: Apr. 20, 2021

(54) MODULAR TRANSFER STATION

(71) Applicant: OTIS ELEVATOR COMPANY, Farmington, CT (US)

(72) Inventors: Tadeusz Pawel Witczak, Farmington, CT (US); Richard J. Ericson, Southington, CT (US); Bruce P. Swaybill, Farmington, CT (US); Richard Ivanic, Erie, PA (US); Kevin Neville, Erie, PA (US); Sven Swanson, Erie, PA (US)

(73) Assignee: Otis Elevator Company, Farmington, CT (US)

( * ) Notice: Subject to any disclaimer, the term of this patent is extended or adjusted under 35 U.S.C. 154(b) by 358 days.

(21) Appl. No.: 15/805,340

(22) Filed: Nov. 7, 2017

(65) Prior Publication Data

US 2018/0127242 A1 May 10, 2018

Related U.S. Application Data

(60) Provisional application No. 62/418,467, filed on Nov. 7, 2016.

(51) Int. Cl.

| | |
|---|---|
| ***B66B 9/00*** | (2006.01) |
| ***B66B 11/00*** | (2006.01) |
| ***B66B 11/04*** | (2006.01) |
| ***B66B 19/00*** | (2006.01) |

(52) U.S. Cl.

CPC ..... *B66B 9/003* (2013.01); *B66B 11/0005* (2013.01); *B66B 11/0407* (2013.01); *B66B 19/00* (2013.01)

(58) Field of Classification Search

CPC ..... B66B 9/003; B66B 11/0407

See application file for complete search history.

(56) References Cited

U.S. PATENT DOCUMENTS

| | | | |
|---|---|---|---|
| 3,094,226 | A | 6/1963 | Gutridge et al. |
| 3,792,785 | A | 2/1974 | Weir |
| 5,012,621 | A | 5/1991 | Power et al. |

(Continued)

FOREIGN PATENT DOCUMENTS

| | | | |
|---|---|---|---|
| CN | 101896416 | A | 11/2010 |
| CN | 105621171 | A | 6/2016 |

(Continued)

OTHER PUBLICATIONS

European Search Report dated Apr. 10, 2018 for corresponding European Patent Application No. 17200302.2.

(Continued)

*Primary Examiner* — Diem M Tran

(74) *Attorney, Agent, or Firm* — Bachman & LaPointe, P.C.

(57) ABSTRACT

A modular transfer station for a passenger conveyance system including a multiple of modular transfer station modules, each of the multiple of modular transfer station modules includes a static structure. A method of assembling a modular transfer station for a passenger conveyance including assembling a first interface lane alignment module to a second a second modular transfer station parking module, wherein each of the multiple of modular transfer station modules includes a generally equivalent static structure.

9 Claims, 5 Drawing Sheets

(56) References Cited

U.S. PATENT DOCUMENTS

| | | | | |
|---|---|---|---|---|
| 5,799,755 | A | 9/1998 | Wan et al. | |
| 5,799,795 | A | 9/1998 | Wan et al. | |
| 5,833,031 | A | 11/1998 | Liebetrau et al. | |
| 6,035,974 | A | 3/2000 | Richter et al. | |
| 9,322,190 | B2 | 4/2016 | Driess | |
| 2011/0042168 | A1 | 2/2011 | Grundmann | |
| 2014/0190774 | A1 | 7/2014 | Hsu et al. | |
| 2016/0040443 | A1 | 2/2016 | Stephenson et al. | |
| 2017/0107080 | A1 | 4/2017 | Steinhauer | |
| 2017/0362061 | A1* | 12/2017 | Witczak | B66B 9/003 |
| 2018/0009636 | A1* | 1/2018 | Jedryczka | B66B 9/003 |
| 2018/0044138 | A1 | 2/2018 | Roberts et al. | |
| 2019/0177125 | A1 | 6/2019 | Gainche | |

FOREIGN PATENT DOCUMENTS

| | | | |
|---|---|---|---|
| CN | 105696788 | A | 6/2016 |
| CN | 109415184 | A | 3/2019 |
| DE | 20206290 | U1 | 8/2002 |
| ES | 2547977 | A1 | 10/2015 |
| WO | 2006131947 | A2 | 12/2006 |
| WO | 2015144781 | A1 | 10/2015 |
| WO | 2016100609 | A1 | 6/2016 |
| WO | 2016106140 | A1 | 6/2016 |
| WO | 2016109338 | A1 | 7/2016 |
| WO | 2016109511 | A1 | 7/2016 |
| WO | 2016126688 | A1 | 8/2016 |
| WO | 2016126933 | A1 | 8/2016 |
| WO | 2018002228 | A1 | 1/2018 |

OTHER PUBLICATIONS

Chinese Office Action dated Mar. 5, 2019 issued for corresponding Chinese Patent Application No. 201711081415.6.

European Office Action dated Sep. 20, 2019 issued for corresponding European Patent Application No. 17200302.2.

Chinese Office Action dated Oct. 16, 2019 issued for corresponding Chinese Patent Application No. 201711081415.6.

* cited by examiner

MODULAR TRANSFER STATION

CROSS-REFERENCE TO RELATED APPLICATION

This application claims the benefit of provisional application Ser. No. 62/418,467, filed Nov. 7, 2016.

BACKGROUND

The present disclosure relates to a passenger conveyance system and, more particularly, to a modular transfer station therefor.

Ropeless elevator systems typically have new build requirements where all connected lanes must have the same dimensions to allow elevator cars to move from one lane to another. The lateral movement mechanism for movement of the elevator cars between lanes typically includes a horizontally disposed transfer station that supports elevator car carriages that, in turn, support the elevator cars.

Installation of the transfer station typically requires precise reference across lane groups.

SUMMARY

A modular transfer station for a passenger conveyance system, according to one disclosed non-limiting embodiment of the present disclosure can include a first modular transfer station lane alignment module operable to translate an car in a first direction and second direction therethrough and a second modular transfer station lane alignment module operable to translate the car in a first direction and second direction therethrough, the second modular transfer station lane alignment module attached to the first modular transfer station lane alignment module.

A further embodiment of the present disclosure may include, wherein the first direction is a horizontal direction and the second direction is a vertical direction, and the passenger conveyance system is an elevator.

A further embodiment of the present disclosure may include a modular transfer station parking module coupled to at least one of the first modular transfer station lane alignment module and second modular transfer station lane alignment module.

A further embodiment of the present disclosure may include a static structure coupled to at least one of the first modular transfer station lane alignment module and second modular transfer station lane alignment module.

A further embodiment of the present disclosure may include an elevator car carriage configured to transport the elevator car from the first modular transfer station lane alignment module to the second modular transfer station lane alignment module.

A further embodiment of the present disclosure may include the first modular transfer station lane alignment module, second modular transfer station lane alignment module, modular transfer station parking module, and basic module each include an elevator car carriage guide that supports the elevator car carriage; and the elevator car carriage includes a propuslor operable to move the elevator car between the first modular transfer station lane alignment module and second modular transfer station lane alignment module.

A further embodiment of the present disclosure may include, wherein the wherein the modular transfer station parking module provides for parking of the elevator car carriage with or without the elevator car.

A further embodiment of the present disclosure may include, wherein the elevator travels in the vertical direction without the elevator car carriage.

A further embodiment of the present disclosure may include at least one modular transfer station parking module coupled to at least one of the first modular transfer station lane alignment module and second modular transfer station lane alignment module.

A further embodiment of the present disclosure may include a static structure coupled to at least one of the first modular transfer station lane alignment module and second modular transfer station lane alignment module.

A further embodiment of the present disclosure may include an car carriage configured to transport the car from the first modular transfer station lane alignment module to the second modular transfer station lane alignment module.

A further embodiment of the present disclosure may include the first modular transfer station lane alignment module, second modular transfer station lane alignment module, and modular transfer station parking module each include a car carriage guide that supports the car carriage; and the car carriage includes a propuslor operable to move the car between the first modular transfer station lane alignment module and second modular transfer station lane alignment module.

A modular transfer station for a passenger conveyance system, according to one disclosed non-limiting embodiment of the present disclosure can include a first modular transfer station lane alignment module and second modular transfer station lane alignment module operable to translate an elevator car horizontally and vertically therethrough; and a modular transfer station parking module operable to translate the elevator car carriage horizontally there through, the modular transfer station parking module coupled to at least one of the first modular transfer station lane alignment module and second modular transfer station lane alignment module.

A further embodiment of the present disclosure may include a modular transfer station static structure attached between at least one of the modular transfer station parking module, first modular transfer station lane alignment module, and second modular transfer station lane alignment module.

A further embodiment of the present disclosure may include, wherein the first modular transfer station lane alignment module each includes an elevator car carriage guide that supports an elevator car carriage.

A further embodiment of the present disclosure may include, wherein the elevator car carriage includes a propuslor operable to horizontally move the elevator car between the first modular transfer station lane alignment module and second modular transfer station lane alignment module.

A further embodiment of the present disclosure may include, wherein the first modular transfer station lane alignment module and second modular transfer station lane alignment module have a generally identical static frame.

A method of assembling a modular transfer station for a passenger conveyance according to one disclosed non-limiting embodiment of the present disclosure can include assembling a first modular transfer station lane alignment module, operable to translate an elevator car horizontally vertically therethrough, to a second modular transfer station lane alignment module operable to translate an elevator car horizontally and vertically therethrough, wherein each of the modular transfer station lane alignment modules includes are the same.

A further embodiment of the present disclosure may include attaching a modular transfer station parking module operable to translate the elevator car horizontally there through, the modular transfer station parking module attached to at least one of the first modular transfer station lane alignment module and second modular transfer station lane alignment module by a basic module.

A further embodiment of the present disclosure may include movably attaching an elevator car carriage to the first modular transfer station lane alignment module and second modular transfer station lane alignment module, wherein the elevator car carriage is configured to move between the first modular transfer station lane alignment module and second modular transfer station lane alignment module.

A further embodiment of the present disclosure may include receiving an elevator car within the elevator car carriage and transporting the elevator car from the first modular transfer station lane alignment module to the second modular transfer station lane alignment module.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
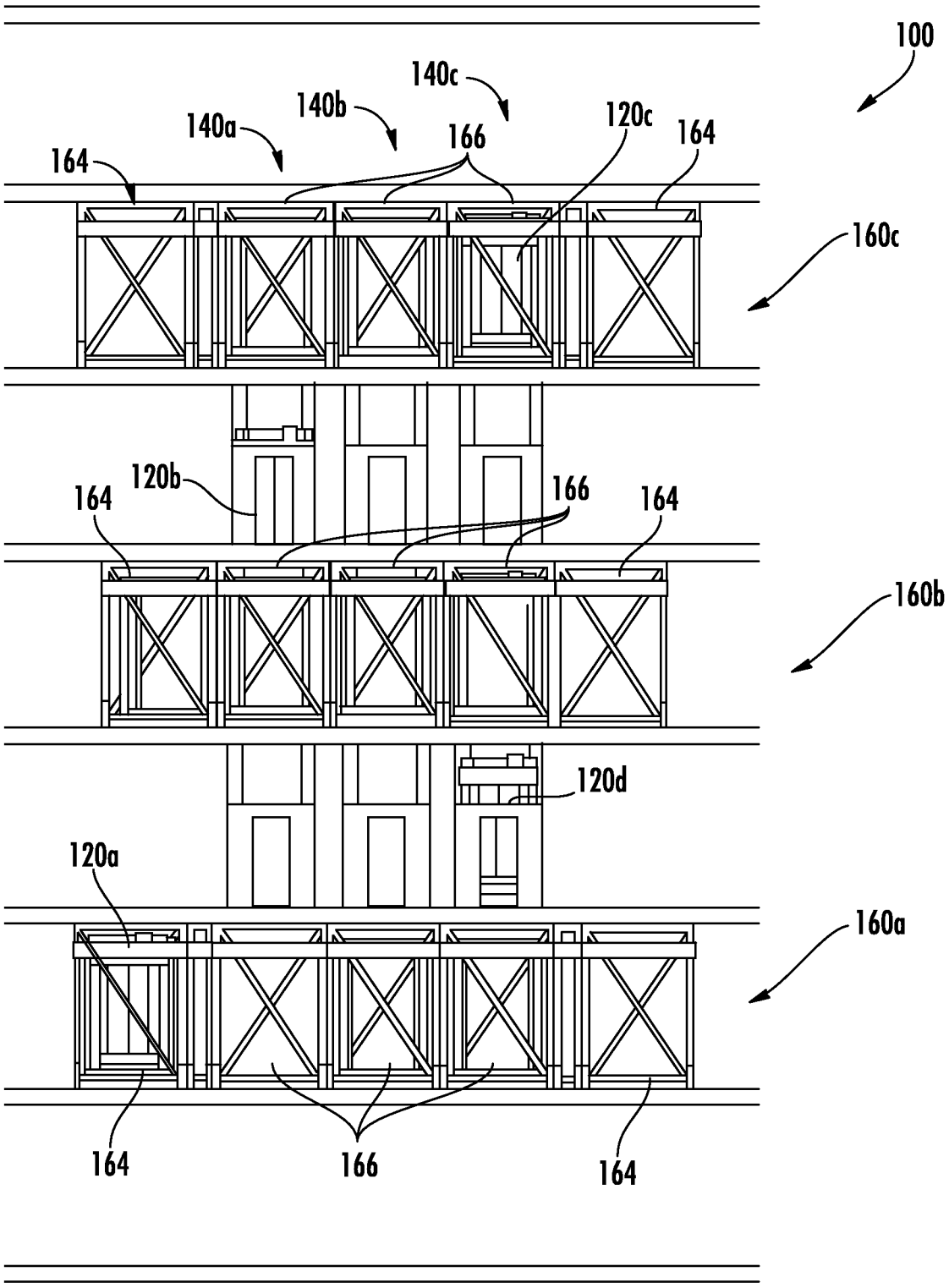
FIG. 1 is a schematic view of a multiple of modular transfer station modules installed in a building according to one disclosed non-limiting embodiment.

FIG. 1 schematically illustrates a passenger conveyance system 100. The system 100 may include a plurality of vertical hoistway lanes 140*a*, 140*b*, 140*c*, configured for travel of a plurality of elevator cars 120*a*, 120*b*, 120*c*, 120*d*, which, in this embodiment, are self-propelled elevator cars 120 having independent drive systems. It should be appreciated that any number of elevator lanes 140*a*, 140*b*, . . . 140*n*, and elevator cars 120*a*, 120*b*, . . . 120*n* may be utilized. In some embodiments, more than one elevator car 120 may be disposed in each hoistway lane 140, thereby allowing for increased passenger traffic in the system 100. It should be appreciated that although particular systems are separately defined, each or any of the systems can include otherwise combined or separated via hardware and/or software.

A modular transfer station 160*a*, 160*b*, 160*c*, may be located at each floor. In one embodiment, there may be a single modular transfer station 160 or two or more modular transfer stations 160. Each modular transfer station 160 provides for the elevator cars 120*a*, 120*b*, 120*c*, 120*d* to be transferred from one vertical hoistway lane 140*a*, 140*b*, 140*c* to another vertical hoistway lane 140*a*, 140*b*, 140*c*. In one embodiment, this permits the direction of travel to be reversed from upward to downward or vice-versa, and the plurality of elevator cars 120*a*, 120*b*, 120*c*, 120*d* to travel in a circulation pattern between the plurality of hoistway lanes 140*a*, 140*b*, 140*c*.

Figure 2:
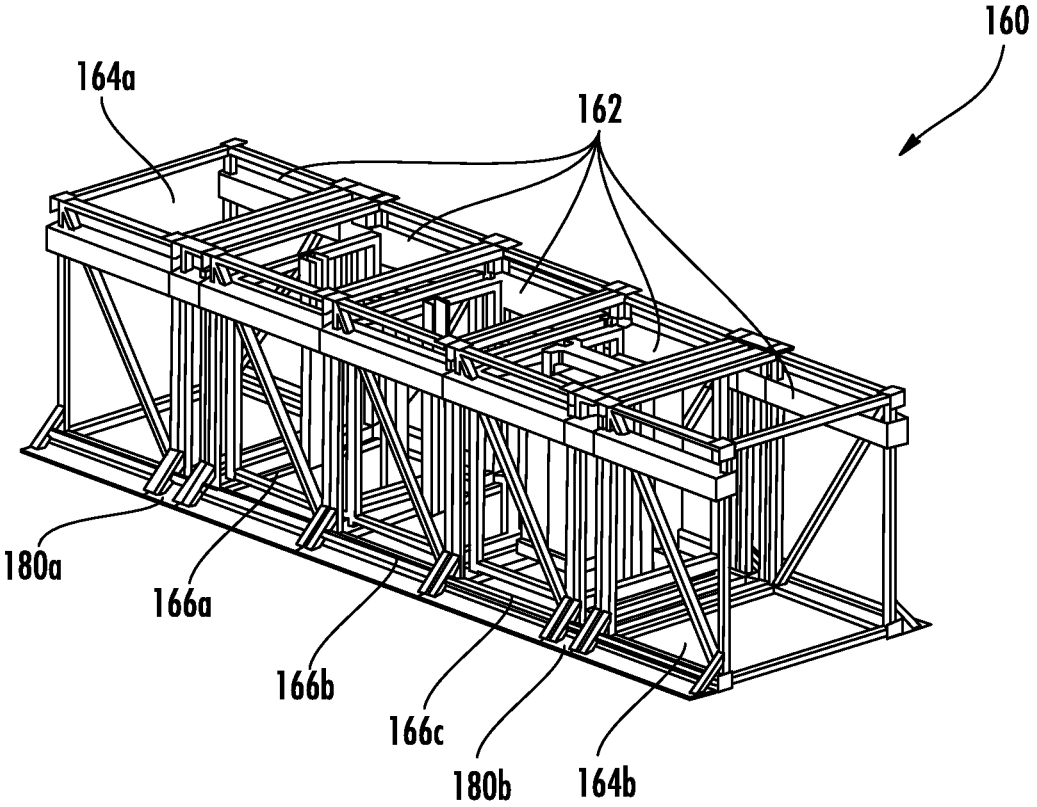
FIG. 2 is a perspective view of a modular transfer station according to one disclosed non-limiting embodiment.

With reference to FIG. 2, the modular transfer station 160 includes a plurality of modular transfer station modules 162 (five shown). The modular transfer station 160, in this embodiment, generally includes two basic modules 180*a*, 180*b*, a modular transfer station lane alignment module 166*a*, 166*b*, 166*c* (three shown) that interface with the hoistway lanes 140*a*, 140*b*, 140*c*, and a modular transfer station parking module 164*a*, 164*b* (two shown). The modular transfer station parking modules 164*a*, 164*b* do not interface with the hoistway lanes 140*a*, 140*b*, 140*c*, and may be located at each end of the modular transfer station lane alignment modules 166.

The basic modules 180*a*, 180*b* operate as optional spacers between other modules such as modular transfer station parking modules 164*a*, 164*b* and modular transfer station lane alignment modules 166*a*, 166*b*, 166*c*. The basic modules 180*a*, 180*b* may be located between adjoining modular transfer station lane alignment modules, adjoining modular transfer station parking modules, or between adjoining modular transfer station lane alignment modules and adjoining modular transfer station parking modules. The basic modules 180*a*, 180*b* are configured of a dimension so as to cause the modular transfer station lane alignment modules to align properly with the vertical hoistway lanes 140*a*, 140*b*, 140*c*. The precise dimensions of the basic modules 180*a*, 180*b* may be tailored to the particular passenger conveyance system 100 in which they are installed. Moreover, any number and configuration of basic modules 180*a*, 180*b* may be used.

The modular transfer station parking modules 164*a*, 164*b* are configured to store an elevator car 120*a*, 120*b*, 120*c*, 120*d* when such elevator car is not in use, thereby allowing the elevator car to be removed from service without interfering with the travel of other elevator cars 120*a*, 120*b*, 120*c*, 120*d* traveling throughout the passenger conveyance system. In one embodiment, there may be a modular transfer station parking module 164*a* or 164*b* only on one end of the modular transfer station 160. In one embodiment, there may be any number of modular transfer station parking modules 164*a*, 164*b*, . . . 164*n* and they may be arranged in any desired configuration within the modular transfer station 160, provided that the modular transfer station parking modules 164*a*, 164*b*, . . . 164*n* are not located in one of the hoistway lanes 140*a*, 140*b*, 140*c*.

The modular transfer station lane alignment modules 166*a*, 166*b*, 166*c* and are operable to move each elevator car 120*a*, 120*b*, 120*c*, 120*d* vertically and horizontally while the modular transfer station parking modules 164*a*, 164*b* and basic modules 180*a*, 180*b* are operable to move the elevator car 120*a*, 120*b*, 120*c*, 120*d* horizontally. In the example of FIG. 2, three modular transfer station lane alignment modules 166*a*, 166*b*, 166*c*, are interlocked together and are flanked by two modular transfer station parking modules 164*a*, 164*b*. Basic modules 180*a*, 180*b* are located between the three lane alignment modules 166*a*, 166*b*, 166*c* and the two modular transfer station parking modules 164*a*, 164*b*. The modular transfer station 160 may be specific to each floor or building installation.

Figure 3:
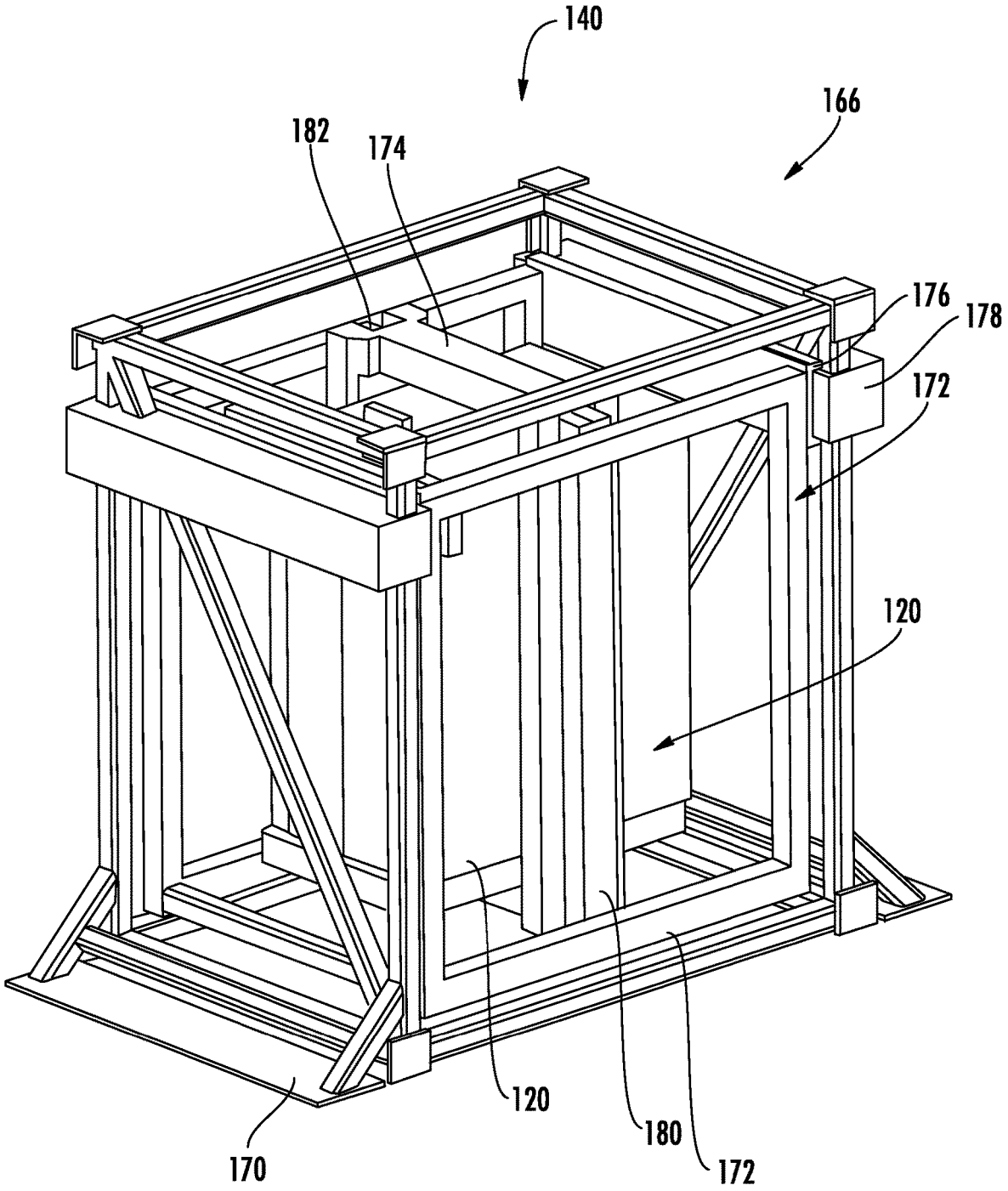
FIG. 3 is an expanded perspective view of a portion of the modular transfer station.

With reference to FIG. 3, an exemplary modular transfer station lane alignment module 166 generally includes a static frame 170 with an elevator car carriage guide 172 that supports an elevator car carriage 174. The static frame 170 is the portion of each module that interlocks with the adjacent modules. That is, the modular transfer station lane alignment modules 166, the modular transfer station parking module 164, and the basic modules 180*a*, 180*b* include a common static frame 170 that interlock one to another in a building block type fashion. The static frame 170 provides an outer structure for a lateral elevator car carriage/elevator car moving mechanism that is modular and can be prefabricated before installation at the construction site. The static frame 170 provides frame work that may be modular and include mounting plates to interface with adjacent modules, power rails to power the elevator car carriage, drives, guidance for elevator car carriage, terminal horizontal motion bumpers/buffers, elevator car carriage position sensors, and/or safety mechanisms. It should be appreciated that various components may be installed across numerous modules.

The elevator car carriage 174 receives the elevator car 120 and laterally moves the elevator car 120 across the modular transfer station 160 to from one modular transfer station module (e.g., lane alignment module, basic module, parking module) to another. It should be appreciated that in some embodiments, the elevator car carriage 174 may not be required as the elevator car 120 may be self-powered or otherwise obviate the usage of an elevator car carriage 174. For example, in some embodiments, the elevator car carriage 174 is configured to transport the elevator cars 120*a*, 120*b*, 120*c*, 120*d* throughout the passenger conveyance system 100. In one embodiment, the elevator cars 120*a*, 120*b*, 120*c*, 120*d* may be transported by the elevator car carriage 174 when moving vertically through a hoistway 140 and may travel horizontally through the modular transfer station 160 on their own, unassisted by the elevator car carriage 174. In one embodiment, the elevator cars 120*a*, 120*b*, 120*c*, 120*d* may travel vertically through the hoistway 140 on their own, unassisted by the elevator car carriage 174, and horizontally through the modular transfer station 160 with the assistance of the elevator car carriage 174. In one embodiment, the elevator cars 120*a*, 120*b*, 120*c*, 120*d* may travel vertically through the hoistway 140 and horizontally through the modular transfer station 160 on their own, unassisted by the elevator car carriage 174.

The elevator car carriage guide 172 may include, for example, a guide rail 176 and a lateral propulsion system 178 such as a rack and pinion system to laterally move the elevator car carriage 174 and/or elevator car 120 between the modular transfer station modules. The elevator car carriage guide 172 may be moved between the modular transfer station modules with or without the elevator car 120. It should also be appreciated that the guide rail 176 and the lateral propulsion system 178 may be mounted across multiple modules 162 in a prefabricated manner to support the necessary mounting points, wiring, and other subcomponents to reduce labor time in the field. This facilitates alignment on the shop floor, thereby simplifying installation into the building.

Each modular transfer station lane alignment module 166 also includes a guide rail 180 and a vertical propulsion system 182 such as a linear motor that is operable to move the elevator car 120 vertically within the hoistway lane 140. It should be appreciated that various vertical propulsion systems 182 that may or may not provide for a self-propelled elevator car 120 may be utilized herewith.

The modular transfer station parking module 164, which does not interface with a hoistway lane 140 (FIG. 1), need only provide the guide rail 176 and the lateral propulsion system 178. The modular transfer station parking module 164 may be used as a parking space for a VIP elevator car, for service, and/or to support the modular transfer station lane alignment modules 166 within the hoistway of a building.

Figure 4:
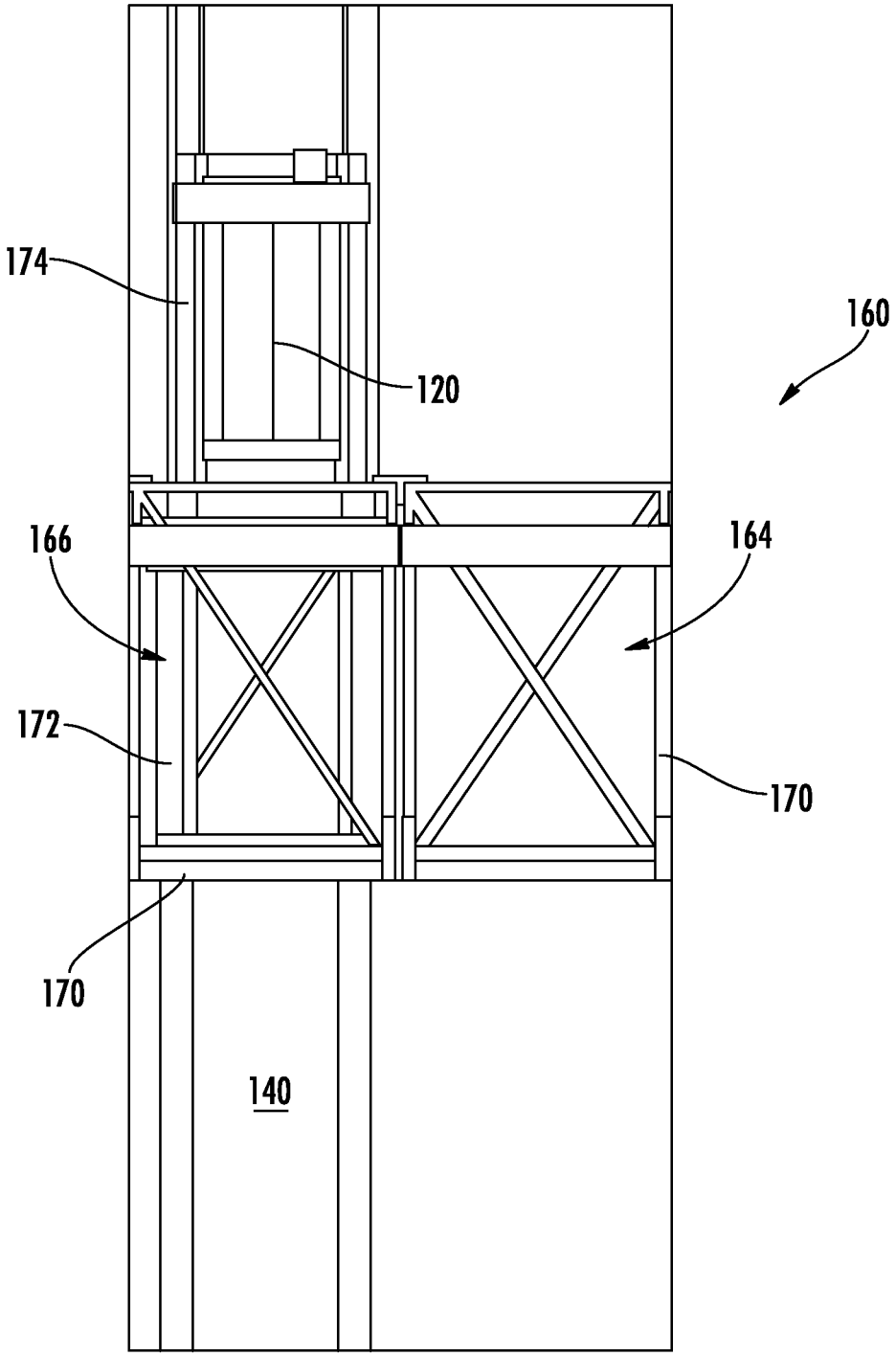
FIG. 4 is an expanded view of a portion of the modular transfer station.

With reference to FIG. 4, an expanded schematic view of a portion of an exemplary modular transfer station 160 is depicted. The exemplary modular transfer station 160 includes a lane alignment module 166 and a parking module 164. In the embodiment of FIG. 4, the elevator car 120 travels both horizontally in the modular transfer station 160 and vertically in the hoistway 140 within the elevator car carriage 174. The modular transfer station 160 includes an elevator carriage guide 172. As shown in FIG. 4, the static frames 170 of the lane alignment module 166 and a parking module 164 are coupled to one another.

Figure 5:
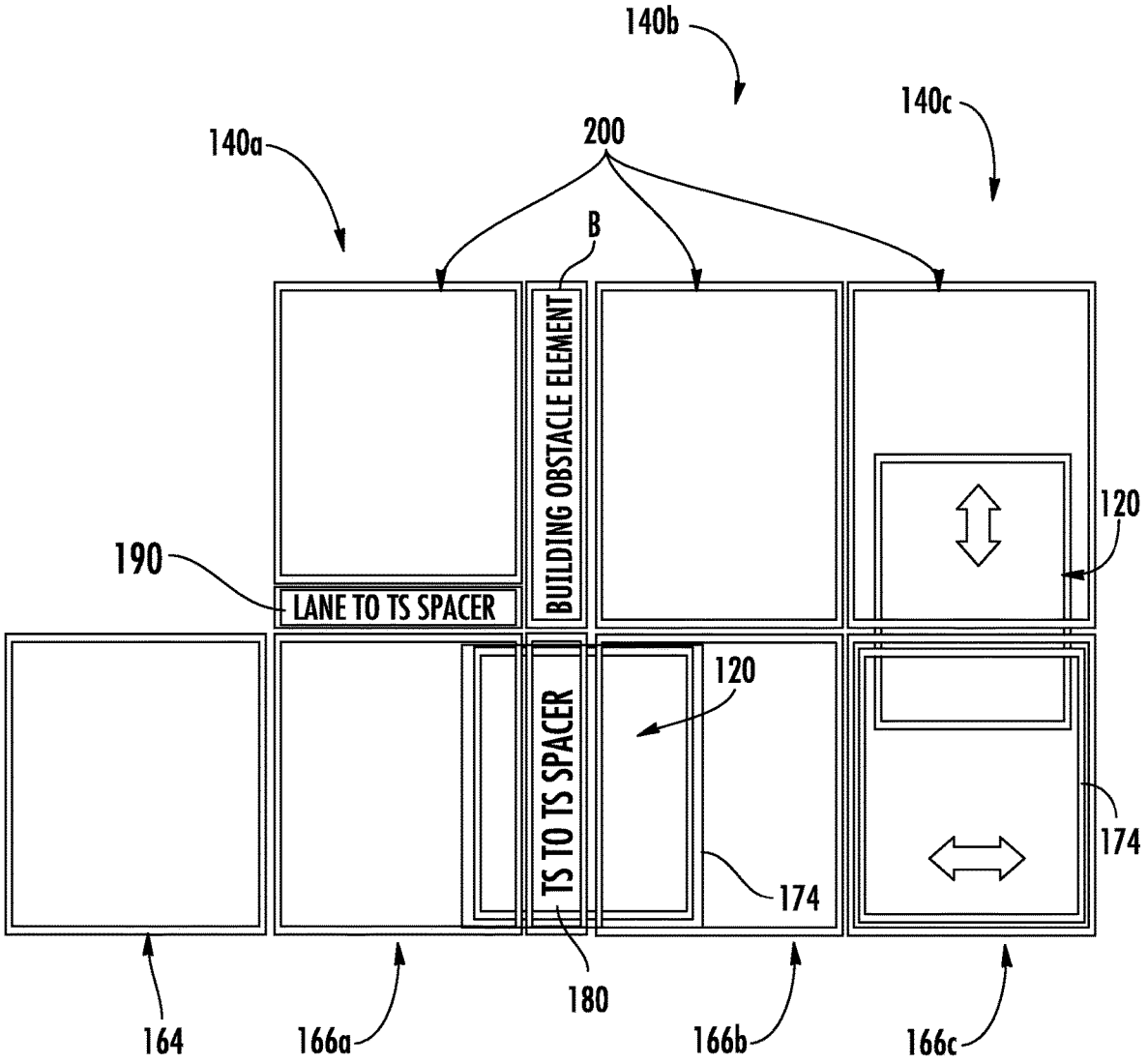
FIG. 5 is a schematic view of the modular transfer station.

With reference to FIG. 5, to further accommodate the structure of the building, basic module 180 is inserted between lane alignment module 166*a* and lane alignment module 166*b*. As discussed above, the basic module 180 spaces the modular transfer station lane alignment modules 166 within a building or other structure to accommodate, for example, a building structure B. The position of the modular transfer station parking module 164 may be less critical as the modular transfer station parking module 164 do not interface with a lane in the building.

A modular transfer station spacer 190 may also be provided to accommodate a hoistway lane module 200 that contains all elements of normal elevator car/lane operation such as vertical elevator car propulsion, guidance, communication, wiring, etc. That is, the lane to modular transfer station spacer 190 provides for vertical spacing.

The modular transfer station 160 at each floor may include various combinations of modular transfer station modules 162 to provide various features for each floor, e.g., VIP elevator car storage, etc. Depending on specific job conditions, the entire modular transfer station 160 may be assembled outside of the hoistway and placed within a building in the early stages of building construction.

The modular transfer station 160 provides a cost saving due to the more automated assembly at the factory, shorter assembly on site, etc.; provides increased safety as there is less employee time in hazardous spaces such as hoistway/pits; higher tolerances for a precise reference system; provides parking in which a horizontal "lane" provides elevator car storage; and includes essentially infinite combinations of modules that are readily adapted to each floor.

The modular transfer station 160 is essentially factory fabricated to improve alignment of related parts via a factory jig or fixture that ensures alignment of guidance members, such as tracks and rail sections, ensuring reliable operation. The factory pre-assembled and fabricated sections may alternatively or additionally be designed to interlock with each other thus minimizing on site construction time and costs. This also has an additional benefit of reducing building construction time and facilitates an in-service elevator that grows upward as the building grows upward. That is the need to wait for the entire building to be completed in order to have a functional elevator that can be used to lift goods and materials to a partially completed building in a single hoist way mode as there is no need to wait until the upper modular transfer station to be completed, as single hoist way operation is possible with only the lower modular transfer station operational.

While the modular transfer station 160 herein was primarily described with respect to an elevator system, the modular transfer system 160 may be used in any type of conveyance system in which lane switching is necessary, such as subways, trams, trolleys, trains, etc. (generally referred to as a "car"), and is not limited exclusively to elevator operations. In addition, while the modular transfer station 160 herein was primarily described with respect to vertical and horizontal movement, the movement may be solely in two directions in the horizontal plane (e.g., x and y planes), or in any combination of directions in the x, y, z planes.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A modular transfer station in a passenger conveyance system for a plurality of vertical hoistway lanes configured for travel of a plurality of elevator cars, the modular transfer station specific to a single floor of a building installation, comprising:

a first modular transfer station lane alignment module operable to translate an elevator car in a horizontal direction across hoistway lanes and a vertical direction within a first hoistway lane, the first modular transfer station lane alignment module comprises a guide rail and a vertical propulsion system operable to move the car vertically within the first hoistway lane;

a second modular transfer station lane alignment module operable to translate the car in a horizontal direction across hoistway lanes and a vertical direction therethrough within a second hoistway lane, the second modular transfer station lane alignment module comprises a guide rail and a vertical propulsion system operable to move the elevator car vertically within the second hoistway lane, the second modular transfer station lane alignment module attached to the first modular transfer station lane alignment module and fixed within the building installation;

a basic module attached between the first modular transfer station lane alignment module and the second modular transfer station lane alignment module to accommodate for a building structure, the basic module not aligned with the first and second hoistway but fixed within the building installation;

a modular transfer station parking module fixed within the building installation and coupled to at least one of the first modular transfer station lane alignment module and the second modular transfer station lane alignment module, the modular transfer station parking module does not interface with the first or second hoistway lane, the modular transfer station parking module comprises a guide rail and a lateral propulsion system;

wherein the first modular transfer station lane alignment module, the second modular transfer station lane alignment module, the modular transfer station parking module and the basic module comprise a common static frame that attach one to another in a building block type fashion, the common static frame prefabricated before installation within the building installation for an elevator car carriage, the common static frame attaches with adjacent modules within the building installation, the elevator car carriage configured to transport the elevator car from the modular transfer station parking module to the first modular transfer station lane alignment module, the elevator car carriage includes a propulsor operable to move the elevator car between the modules fixed within the building installation, the elevator car carriage movable into the modular transfer station parking module with or without the elevator car, the elevator car operable to travel in the vertical direction without the elevator car carriage.

2. The modular transfer station as recited in claim 1, wherein the common static frame attaches with adjacent modules via mounting plates fixed within the building installation.

3. A modular transfer station for a passenger conveyance system, comprising:

a first modular transfer station lane alignment module operable to translate an elevator car in a horizontal direction across hoistway lanes and a vertical direction within a first hoistway lane, the first modular transfer station lane alignment module comprises a guide rail and a vertical propulsion system operable to move the car vertically within the first hoistway lane;

a second modular transfer station lane alignment module operable to translate the car in a horizontal direction across hoistway lanes and a vertical direction therethrough within a second hoistway lane, the second modular transfer station lane alignment module comprises a guide rail and a vertical propulsion system operable to move the elevator car vertically within the second hoistway lane, the second modular transfer station lane alignment module attached to the first modular transfer station lane alignment module;

a modular transfer station parking module coupled to at least one of the first modular transfer station lane alignment module and second modular transfer station lane alignment module, the modular transfer station parking module does not interface with a hoistway lane, the modular transfer station parking module comprises a guide rail and a lateral propulsion system;

a basic module attached between the first modular transfer station lane alignment module and the second modular transfer station lane alignment module to accommodate for a building structure, the basic module not aligned with the first and second hoistway;

wherein the first modular transfer station lane alignment module, the second modular transfer station lane alignment module, the modular transfer station parking module, and the basic module comprise a common static frame that attach one to another in a building block type fashion fixed within the building installation, the common static frame is prefabricated before installation within the building installation for the elevator car carriage, the common static frame attaches with adjacent modules that are fixed within the building installation.

4. The modular transfer station as recited in claim 3, wherein the first modular transfer station lane alignment module each includes an elevator car carriage guide that supports an elevator car carriage.

5. The modular transfer station as recited in claim 4, wherein the elevator car carriage includes a propulsor operable to horizontally move the elevator car between the first modular transfer station lane alignment module and second modular transfer station lane alignment module.

6. A method of assembling a modular transfer station for a passenger conveyance for a plurality of vertical hoistway lanes configured for travel of a plurality of elevator cars, the modular transfer station specific to a single floor of a building installation, comprising:

factory fabricating a first modular transfer station lane alignment module off-site of a building installation;

manufacturing a second modular transfer station lane alignment module off-site of the building installation;

assembling the first modular transfer station lane alignment module to be fixed within the building installation, operable to translate an elevator car horizontally and vertically therethrough, to a second modular transfer station lane alignment module fixed within the building installation operable to translate the elevator car horizontally and vertically therethrough at the building installation site, wherein the modular transfer station lane alignment modules, the modular transfer station parking module, and the basic modules each include a common static frame that attach one to another in a building block type fashion, the common static frame prefabricated before installation within the building installation for the elevator car carriage, the common static frame attaches with the adjacent modules and are fixed within the building installation;

movably attaching an elevator car carriage to the first modular transfer station lane, alignment module and second modular transfer station lane alignment module, wherein the elevator car carriage is configured to move between the first modular transfer station lane alignment module and second modular transfer station lane alignment module; and receiving an elevator car within the elevator car carriage and transporting the elevator car from the first modular transfer station lane alignment module to the second modular transfer station lane alignment module that are fixed within the building installation.

7. The method as recited in claim 6, further comprising:

factory fabricating a modular transfer station parking module off-site of the building installation; and attaching a modular transfer station parking module operable to translate the elevator car horizontally there through, the modular transfer station parking module attached to at least one of the first modular transfer station lane alignment module and second modular transfer station lane alignment module by a basic module.

8. The method as recited in claim 7, further comprising attaching two modules with the basic module, the basic module configured so as to cause the modular transfer station lane alignment modules to align properly with the vertical hoistway lanes.

9. The method as recited in claim 6, further comprising:

factory fabricating a basic module attached between the first modular transfer station lane alignment module and the second modular transfer station lane alignment module, off-site of the building installation; and attaching the basic module between the first modular transfer station lane alignment module and the second modular transfer station lane alignment module at the building site to accommodate for a building structure, the basic module not aligned with the first and second hoistway.

* * * * *